US005765762A

United States Patent [19]

Lee et al.

[11] Patent Number: 5,765,762

[45] Date of Patent: Jun. 16, 1998

[54] SPRAY GUN TYPE ELECTROSTATIC PAINT COATING MACHINE

[75] Inventors: Hoyang Lee; Shinichi Takayama, both of Tokyo, Japan

[73] Assignee: ABB Industry K.K., Tokyo, Japan

[21] Appl. No.: 704,678

[22] PCT Filed: Jan. 17, 1996

[86] PCT No.: PCT/JP96/00053

§ 371 Date: Sep. 19, 1996

§ 102(e) Date: Sep. 19, 1996

[87] PCT Pub. No.: WO96/23591

PCT Pub. Date: Aug. 8, 1996

[30] Foreign Application Priority Data

Jan. 30, 1995 [JP] Japan ..... 7-033046
Sep. 11, 1995 [JP] Japan ..... 7-258191

[51] Int. Cl.[6] ..... B05B 5/043; B05B 5/053

[52] U.S. Cl. ..... 239/690.1; 239/704; 239/706

[58] Field of Search ..... 231/3, 693, 696, 231/708, 706, 707

[56] References Cited

U.S. PATENT DOCUMENTS

| | | | |
|---|---|---|---|
| 3,393,662 | 7/1968 | Blackwell . | |
| 3,937,401 | 2/1976 | Luderer et al. . | |
| 4,009,829 | 3/1977 | Sickles . | |
| 4,079,894 | 3/1978 | Harjar et al. . | |
| 4,440,349 | 4/1984 | Sickles et al. | 239/708 X |
| 4,508,265 | 4/1985 | Jido | 239/708 X |
| 4,611,762 | 9/1986 | Turner et al. | 239/708 |
| 4,771,949 | 9/1988 | Behr et al. . | |
| 4,854,506 | 8/1989 | Noakes et al. | 239/708 |

FOREIGN PATENT DOCUMENTS

| | | |
|---|---|---|
| 47-31088 | 8/1972 | Japan . |
| 53-24366 | 3/1978 | Japan . |
| 53-30646 | 3/1978 | Japan . |
| 55-23104 | 6/1980 | Japan . |
| 56-38267 | 9/1981 | Japan . |
| 57-13346 | 3/1982 | Japan . |
| 58-22261 | 5/1983 | Japan . |
| 61-78452 | 4/1989 | Japan . |

*Primary Examiner*—Kevin Weldon
*Attorney, Agent, or Firm*—Oblon, Spivak, McClelland, Maier & Neustadt, P.C.

[57] ABSTRACT

A spray gun type electrostatic paint coating machine which is capable of improving quality of coated surfaces, the coating machine including an air nozzle (8) and a paint nozzle (21) respectively provided at the fore end of a spray gun body (6). The spray gun body (6) and the air nozzle (8) are made of an electrically insulating material, while the paint nozzle (21) is made of a metallic material including a paint spouting orifice (21C) which is projected on the front side through the air nozzle (8). The paint spouting orifice (21C) is connected to ground through a paint supply passage (10) to serve as a grounding electrode. Sprayed paint particles are at the earth potential, so that they are less susceptible to influences of dielectric polarization and negatively charged quickly by the high negative voltage of the external electrode. As a consequence, sprayed paint particles are prevented from depositing on the air nozzle (8) or other negatively charged surfaces and falling down in the form of discrete dot-like driblets to contaminate a coated surface.

16 Claims, 9 Drawing Sheets

SPRAY GUN TYPE ELECTROSTATIC PAINT COATING MACHINE

TECHNICAL FIELD

This invention relates to a spray gun type electrostatic paint coating machine particularly suitable for use in spray-coating a water-base paint or a metallic paint.

BACKGROUND ART

Generally, paints which have been in use for electrostatic coating can be largely classified into solvent type paints (oil-base paints) which are relatively large in electrical resistance and water-base paints (water paints) which are relatively small in electrical resistance. Further, there have been in use the so-called metallic paints which have metallic powder dispersed in a solvent type paint or in a water-base paint. Similarly to water-base paints, metallic paints are known to be relatively small in electrical resistance. As will be gathered therefrom, the paints which are currently in use have different values in electrical resistance depending upon the type, necessitating to employ different methods for paints of different types in applying voltage thereto in electrostatic spray-coating operations.

More specifically, normally a paint supply passage, a paint tank and a color-changer of a coating machine are grounded during coating operations from a viewpoint of preventing dangerous situations, although solvent type paints have a relatively large electrical resistance. Therefore, in the case of a solvent type paint, even if a high voltage is applied to a center electrode on a spray gun body directly from an external high voltage generator, there is little possibility of the spray gun body being grounded to the earth potential through the paint supply passage. For this reason, with a solvent type paint spray gun, it has been the usual practice to charge paint particles by applying a high voltage directly to the spray gun body.

On the other hand, in the case of a water-base paint or a metallic paint of low electrical resistance, if a high voltage is applied directly to a center electrode provided on a spray gun body, it is very likely that the spray gun body is easily short-circuited to the earth potential, failing to charge paint particles to any practical degree.

In this regard, in the case of a water-base paint or a metallic paint, prior art spray gun type electrostatic paint coating machines employ an external electrode system having an external electrode body located radially outward of a spray gun body which is connected to ground, and supplying a high voltage (e.g., of −60 kV to −90 kV) to the external electrode through a high resistance and high voltage cable.

Shown by way of example in FIGS. 8 and 9 is a prior art spray gun type electrostatic paint coating machine employing an external electrode of the sort as mentioned above.

In these figures, indicated at 1 is a spray gun type electrostatic paint coating machine, which includes a mount member 2 to be fixed on a reciprocator (not shown) or the like, a valve mount structure 3 supporting thereon paint valves 16 and 17 along with a drain valve (not shown), a coating machine head 4 securely fixed on the valve mount structure 3, and an external electrode 5 securely fixed at one side of the valve mount structure 3 and disposed parallel with and outward of the circumference of the coating machine head 4.

The construction of the coating machine head 4 is shown in detail in FIG. 9.

In FIG. 9, the reference 6 denotes a spray gun body of an elongated tubular form, which is formed of an electrically insulating synthetic resin material such as polytetrafluoroethylene (PTFE) or polyethylene terephthalate (PET) or the like. The spray gun body 6 is formed with an rearwardly tapered recess at its fore distal end to provide a nozzle receptacle 6A which receives a paint nozzle 7, which will be described below. The rear or base end of the spray gun body 6 is securely fixed to the valve mount structure 3.

The paint nozzle 7, which is also made of an electrically insulating synthetic resin material such as PTFE, PET or the like, is threaded centrally into the fore distal end of the spray gun body 6, and internally provided with a paint supply passage. In this instance, the paint nozzle 7 is constituted by a rearwardly tapered fitting portion 7A which fits in the nozzle receptacle portion 6A of the spray gun body 6, a valve seat portion 7B projected forward from the bottom portion and reduced into a smaller diameter toward its fore end for seating and unseating a needle valve body 18 as will be described later, a paint spouting orifice 7C provided at the fore end of the valve seat portion 7B for spraying a paint when the needle valve body 18 is opened, an atomizing air passage 7D formed around the outer periphery of the valve seat portion 7B, and an annular projection 7E positioned around the outer periphery of the atomizing air passage 7D and projected forward in the form of an annular ring of a larger diameter and in abutting engagement with a recessed portion 8A of an air nozzle 8 which will be described below.

The air nozzle 8, which covers the fore end of the paint nozzle 7, is securely fixed on a fore end portion of the spray gun body 6 through a retainer ring 9. The air nozzle 8 is also made of an electrically insulating synthetic resin material such as PTFE, PET or the like, and constituted by a recessed portion 8A which is held in abutting engagement with the above-described annular projection 7E, a front wall portion 8B which is formed in such a manner as to cover the front side of the recessed portion 8A, forwardly projecting horn portions 8C which are provided in radially opposing positions on the upper and lower sides of the front wall portion 8B, a nozzle threading hole 8D bored through the front wall portion 8B at a position on the center axis of the front wall portion to receive a forwardly projected open end of the paint spouting orifice 7C, a large number of atomizing air outlets 8E formed in the front wall portion 8B around the centrally located nozzle holder hole, and patterning air spout holes 8F (only two of which are shown in the drawing) which are formed in the horn portions 8C and opened obliquely in an inward direction. The air nozzle 8 functions to accelerate atomization of a paint which is sprayed forward from the paint spouting orifice 7C of the paint nozzle 7, by spurting atomizing air blasts from the nozzle threading hole 8D and the respective atomizing air outlets 8E, while blowing patterning air toward a spray of atomized paint particles from the patterning air outlets 8F to shape the spray into an elliptic or oval form.

Denoted at 10 is a paint supply passage which is formed between the needle valve body 18 and the spray gun body 6, and which is connected to a front paint valve 16 and a rear paint valve 17 as will be described below. Through this paint supply passage 10, the paint is maintained at the earth potential. Indicated at 11 is a paint drain passage which connects a fore end portion of the paint supply passage 10 to an external drain tank through a drain valve (not shown) which is provided in the paint drain passage 11. The reference 12 indicates an atomizing air supply passage which is bored axially through the spray gun body 6.

Shown at 13 is an external electrode which is located at a position radially outward of the spray gun body 6. The external electrode 13 is retained in position by an external electrode holder 14. In this instance, the external electrode holder 14 is made of an electrically insulating synthetic resin material such as PTFE, PET or the like, and formed in a bottle-like shape in outer configuration having a larger diameter portion 14A and a smaller diameter portion 14B respectively at the rear and fore end portions of a rod-like body with a tapered shoulder portion 14C. The external electrode 13 is connected to a high voltage generator (not shown) through a lead wire 15 which is connected to a rear base end portion of the external electrode holder 14. Namely, from a high voltage generator which is not shown, a high voltage is supplied to the external electrode 13 through the lead wire 15.

Indicated at 16 and 17 are the afore-mentioned front and rear paint valves which are provided within the length of the paint supply passage 10 on the valve mount structure 3. These front and rear paint valves 16 and 17 are connected to a paint tank and a color changing device which are also grounded to earth. Further, these paint valves 16 and 17 are arranged as spring return type 2-port 2-position pneumatic change-over valves which can be switched into desired positions by charging and discharging compressed air. As soon as both of the paint valves 16 and 17 are opened, a paint is fed to the paint nozzle 7 from an external color changing device which is not shown.

In this instance, the paint valve 16 on the front side has a valve body in the form of a needle valve body 18 of a conductive metal as shown in FIG. 9. For example, the needle valve body 18 is made of stainless steel or other conductive metallic material. The needle valve body 18 is connected to an air-driven actuator at its rear end and extended forward in the axial direction of the spray gun body 6 in its fore end portion terminating in a fore distal end portion 18A of the needle valve body 18 to be seated on and off the valve seat portion 7B on the part of the paint nozzle 7. Accordingly, when compressed air is supplied to the front paint valve 16, the fore distal end portion 18A of the needle valve body 18 is unseated from the valve seat portion 7B to open the paint spouting orifice 7C, permitting the paint in the paint supply passage 10 to spurt out forward of the paint nozzle 7.

In operation, the above-described prior art spray gun type electrostatic coating machine 1 functions in the manner as follows. Now, if a high voltage of −60 to −90 kV is applied to the external electrode 13, a charging electrostatic field zone (an ionizing zone) is formed between the external electrode 13 and the paint supply passage 10 which is at the earth potential, and at the same time a paint transporting electrostatic field zone is formed by lines of electrical forces between the external electrode 13 and an article (not shown) to be coated. The paint particles sprayed out of the paint nozzle 7 are negatively charged indirectly by negative ions while passing through the charging electrostatic field zone, and the charged paint particles are transported along the paint transporting electrostatic field zone toward and deposited on the coating article.

In this manner, even a water-base paint or a metallic paint, which is relatively low in electrical resistance, can be coated on an article by the use of a spray gun type electrostatic coating machine with an external electrode.

In this connection, it is to be noted that, in the above-described prior art spray gun type electrostatic coating machine 1, sprayed paint particles are firstly spouted in the form of liquid threads from the paint spouting orifice 7C of the paint nozzle 7 and then divided into fine particles by the action of atomizing air blasts from the atomizing air outlets 8E, forming a predetermined paint spray pattern under the influence of the action of patterning air from the patterning air outlets 8F. However, under circumstances like this, the atomized paint particles are not necessarily subjected uniformly to the energy of atomizing air, often developing turbulent flows in outer peripheral regions of the spray pattern in addition to temporary stagnation of paint particles around the air nozzle 8 off the spray pattern, to a certain degree depending upon differences in particle size and traveling speed.

Besides, the paint nozzle 8 and the air nozzle 7, which are formed of an insulating synthetic resin material, each act as a dielectric tending to hold negative charges on their surfaces under the influence of the high voltage output of the external electrode 13.

Further, immediately after being sprayed from the paint spouting orifice 7B of the paint nozzle 7, the sprayed paint particles undergo the phenomenon of dielectric polarization due to a large voltage difference between the paint nozzle 7 and the external electrode 13, and therefore the paint particles are imparted with a tendency toward positive charging.

Consequently, a part of the paint particles, just sprayed out from the paint nozzle have a tendency toward positive charging and are urged to deposit immediately on and around the negatively charged air nozzle 8 to cause contamination of the air nozzle 8 and adjacent surfaces. Especially, the paint particles which fall off the spray pattern and stagnate temporarily around the air nozzle 8 in the manner as mentioned hereinbefore, are more likely to be adsorbed on the surfaces of the air nozzle 8 because of their tendency toward positive charging instead of negative charging.

These behaviors of sprayed paint particles lead to paint deposition on and in the vicinity of the air nozzle 8, which falls off the coating machine to deposit on a coated surface of an article as discrete dots of small diameters (generally referred to as "paint driblets") which degrade the quality of coatings to a considerable degree.

In view of the above-described problems or drawbacks of the prior art, it is an object of the present invention to provide a spray gun type electrostatic paint coating machine which is capable of negatively charging paint particles quickly as soon as they are sprayed from a paint nozzle.

DISCLOSURE OF INVENTION

In accordance with the present invention, the above-stated objective is achieved by the provision of a spray gun type electrostatic paint coating machine which essentially includes: a spray gun body; a paint nozzle located at the fore end of the spray gun body and having a paint spouting orifice to spray a paint toward an article to be coated; a paint valve provided in the spray gun body and having a needle valve body to open and close the paint nozzle for opening and stopping supply of the paint to the paint nozzle through the paint supply passage; and an external electrode located in a position radially outward of the spray gun body; characterized in that: the spray gun body is made of an electrically insulating material and provided with a grounding electrode at or in the vicinity of the paint spouting orifice.

In accordance with the present invention, there is also provided a spray gun type electrostatic paint coating machine which essentially includes: a spray gun body; a paint nozzle located at the fore end of the spray gun body and having a paint spouting orifice to spray a paint toward an article to be coated; an air nozzle securely mounted on the spray gun body in such a way as to cover the front side of the paint nozzle while exposing the paint spouting orifice to the outside; a paint valve provided in the spray gun body and having a needle valve body to open and close the paint nozzle for opening and stopping the supply of the paint to the paint nozzle through the paint supply passage; and an external electrode located in a position radially outward of the spray gun body; characterized in that: the spray gun body and the air nozzle are made of an electrically insulating material and provided with a grounding electrode in the vicinity of the paint spouting orifice.

The provision of the grounding electrode in the vicinity of the paint spouting orifice makes it possible to hold the paint particles approximately at the earth potential immediately after they are sprayed from the paint spouting orifice, thereby lessening the influences of dielectric polarization as would otherwise occur due to a voltage difference between the paint spouting orifice and the external electrode, letting sprayed paint particles be negatively charged in an accelerated manner by the high negative voltage generated by the external electrode.

In this particular form of the invention, the paint nozzle is made of a conductive material to function as a grounding electrode at or in the vicinity of the outer end of its paint spouting orifice, utilizing the paint spouting orifice of the paint nozzle for the grounding electrode which permits to spray paint particles at a potential which is akin to the earth potential.

Alternatively, according to the invention, the needle valve body is provided with a grounding electrode which is projected forward through the paint spouting orifice of the paint nozzle, similarly permitting to spray paint particles approximately at the earth potential and forward of the projected end of the paint spouting orifice.

Further, in accordance with the present invention, the paint nozzle is made of a conducting material only at a fore paint spouting end portion, and the remainder of the nozzle is made of an electrically insulting material. In this case, a paint spouting end portion of the paint nozzle serves as a grounding electrode for spraying paint particles forward approximately at the earth potential.

In this instance, the grounding electrode is maintained at the earth potential by way of the paint which flows through the paint supply passage, more specifically, by way of a water-base paint or other conductive paint of low electrical resistance.

Furthermore, the above-described grounding electrode may be maintained at the earth potential by way of a grounding wire which is additionally provided on the spray gun body.

BEST MODE FOR CARRYING OUT THE INVENTION

The present invention is described more particularly by way of its preferred embodiments with reference to the accompanying drawings.

Figure 1:
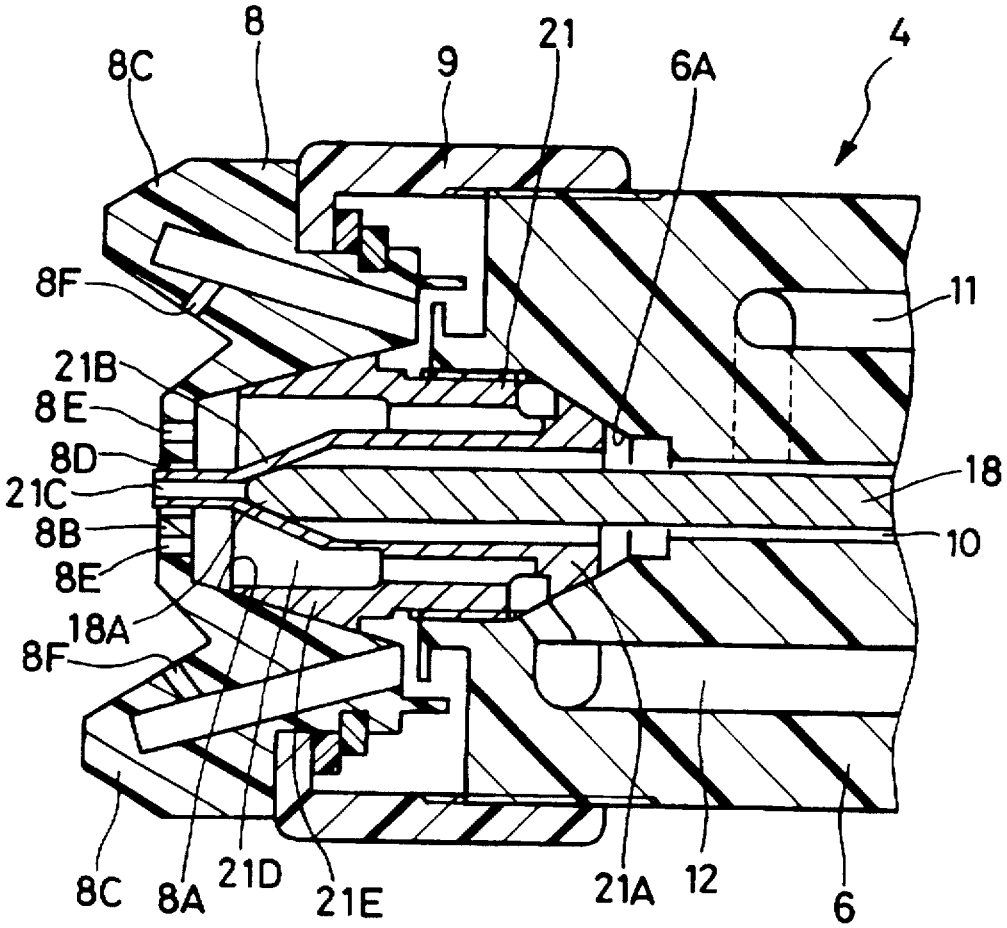
FIG. 1 is a fragmentary longitudinal section of a spray gun type electrostatic paint coating machine shown as a first embodiment of the invention.

Illustrated in FIG. 1 is a first embodiment of the invention, in which the component parts common with the above-described prior art counterpart are simply designated by common reference numerals or characters without repeating same explanations.

In this figure, indicated at 21 is a paint nozzle which is employed in this embodiment in place of the prior art paint nozzle 7 of an insulating synthetic resin material. The paint nozzle 21 is made of a conducting metallic material such as brass, stainless steel or the like to serve as a grounding electrode as will be described below.

The paint nozzle 21 is shaped similarly to the prior art paint nozzle 7 described above, including an internal paint passage and a configuration which is tapered toward its rear end. In this particular embodiment, the paint nozzle 21 is largely constituted by a fitting portion 21A which is fitted in a nozzle receptacle recess 6A on a spray gun body 6, a valve seat portion 21B for seating and unseating a needle valve body 18, a paint spouting orifice 21C provided at the fore end of the valve seat portion 21B to spray a paint forward when the needle valve body 18 is opened, an atomizing air passage 21D formed around the outer periphery of the valve seat portion 21B, and an annular projection 21E in the form of an annular ring of a larger diameter located around the outer periphery of the atomizing air passage 21D and projected forward into abutting engagement with a recess 8A on an air nozzle 8. The paint spouting orifice 21C of the paint nozzle 21 is protruded and opened to the outside through a nozzle threading hole 8D of the air nozzle 8.

The above-described paint supply passage 10 is maintained approximately at the earth potential by way of a metallic or water-base paint of low electrical resistance, which flows through the paint supply passage 10, and the paint valves 16 and 17 which are grounded through respective paint tanks and a color changing device (which are not shown). Therefore, the paint nozzle 21 which is made of a conducting material is maintained at the earth potential through the paint supply passage 10, so that the paint spouting orifice 21C of the paint nozzle 21 can serve as a grounding electrode. Further, the needle valve body 18 which is likewise made of a conducting metallic material contributes to maintain the paint nozzle 21 at the earth potential in cooperation with the paint supply passage 10.

In a manner similar to the prior art counterpart described hereinbefore, the electrostatic paint coating machine of this embodiment with the foregoing arrangements is operated to spray paint particles forward from the paint spouting orifice 21C. The sprayed paint particles are negatively charged in a charging electrostatic field zone (an ionizing zone) formed between the external electrode 13 and the paint nozzle 21, which serves as a grounding electrode at or in the vicinity of the paint spouting orifice 21C. The negatively charged paint particles are then urged to travel toward and deposit on a coating article, through a paint transporting electrostatic field zone which is formed between the external electrode 13 and the coating article.

In this regard, according to the above-described embodiment of the invention, the spray gun body 6 and the air nozzle 8 are made of an insulating synthetic resin material while the paint nozzle 21 is made of a metallic material and has its paint spouting orifice 21C projected forward of the front wall 8B of the air nozzle 8. Therefore, in a coating operation, the paint nozzle 21 is grounded by way of the paint of low electrical resistance, which flows through the paint supply passage 10, so that it serves as a grounding electrode at or in the vicinity of the paint spouting orifice 21C.

Therefore, the paint spouting orifice 21C is capable of spraying paint particles forward approximately at the earth potential, thereby suppressing the influences of dielectric polarization which would otherwise occur due to a voltage difference between the paint spouting orifice 21C and the external electrode 13. It follows that the sprayed paint particles, just coming out of the paint spouting orifice 21C, are still electrically in a neutral state (at the earth potential) instead of picking up a tendency toward positive charging, and can be negatively charged promptly in the negatively charging electrostatic field zone which is formed by the external electrode 13. In this case, it is possible to effect the negative charging even to those paint particles which fall off the spray pattern and tend to stagnate around or in the vicinity of the air nozzle 8.

As a consequence, since the air nozzle 8 and the spray gun body 6 are made of an insulating synthetic resin material, it becomes possible to negatively charge sprayed paint particles in an accelerated manner even in a case where surfaces of the air nozzle 8 are constantly in a negatively charged state under the influence of the high voltage from the external electrode 13, thereby preventing contamination of the air nozzle 8 by deposition of paint particles, which would eventually drop on a coated surface to form the so-called driblets or similar dot-like defects thereon. Accordingly, there can be obtained finish coatings of improved quality, free of contamination as caused by falling paint driblets.

Figure 2:
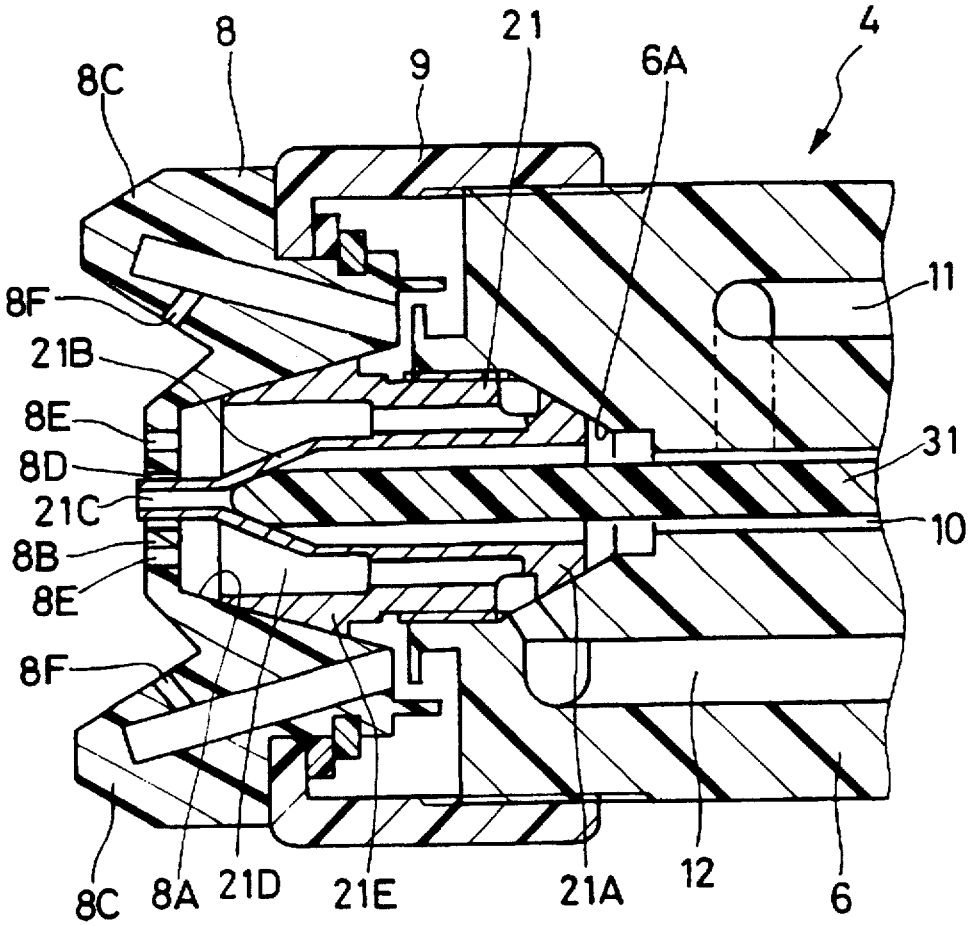
FIG. 2 is a view similar to FIG. 1 but showing a modification of the first embodiment.

In place of the needle valve body 18 of a metallic material which is employed for the paint valve 16 in the foregoing first embodiment similarly to the prior art counterpart, a needle valve body 31 of an insulating synthetic resin material may be used as shown in the modification of FIG. 2. In this case, the paint nozzle 21 also functions as a grounding electrode through a paint of low electrical resistance which flows through the paint supply passage 10, producing substantially the same effects as in the first embodiment.

Figure 3:
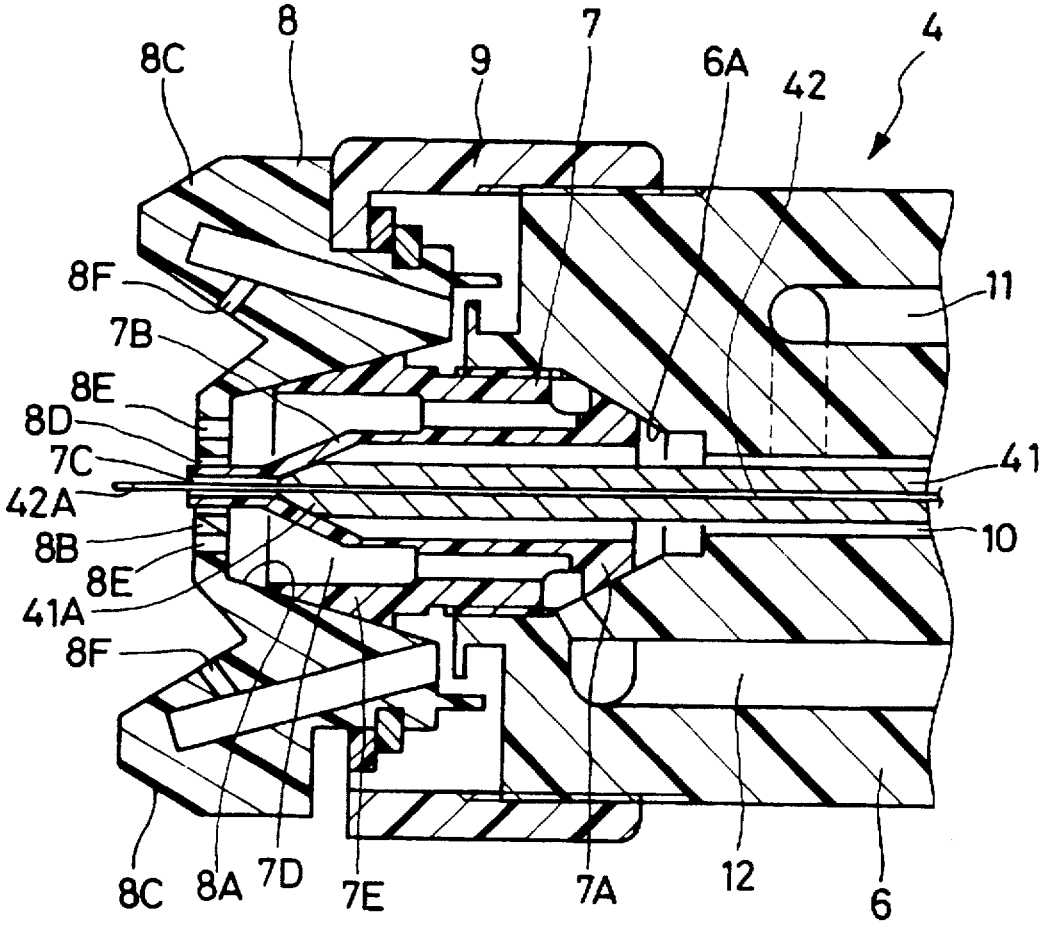
FIG. 3 is a fragmentary longitudinal section of a spray gun type electrostatic paint coating machine shown as a second embodiment of the invention.

Referring now to FIG. 3, there is shown a second embodiment of the invention, which is characterized by the provision of a grounding electrode which is embedded in the needle valve body of the front paint valve 16 in such a manner as to project through the paint spouting orifice. In the following description of this embodiment, the component parts identical with the corresponding parts in the foregoing first embodiment are simply designated by the same reference numerals or characters to avoid repetition of the same explanations.

In FIG. 3, indicated at 41 is a needle valve body which is employed in this embodiment in place of the needle valve body 18 of the first embodiment. The needle valve body 41 is extended axially toward the fore end of the spray gun body 6, the needle valve body 41 having a fore end portion 41A to be seated and unseated on and off the valve seat portion 7B of the paint nozzle 7 which is formed of an insulating synthetic resin material.

Denoted at 42 is a grounding electrode which is provided axially within the needle valve body 41, the grounding electrode 42 having its base end grounded through an air-driven actuator of the front paint valve 16 and its fore end 42A projected forward of the front wall portion 8B of the air nozzle 8.

In the case of the electrostatic paint coating machine of this embodiment with the above-described arrangements, paint particles sprayed forward from the paint spouting orifice 7C are also negatively charged in the charging electrostatic field zone formed between the external electrode 13 and the fore end 42A of the grounding electrode 42 which is retained at the earth potential. Charged paint particles are transferred toward and deposited on an article to be coated, through the paint transporting electrostatic field zone which is formed between the external electrode 13 and the coating article.

Further, according to this embodiment employing the grounding electrode 42 which has its fore end 42A projected outward through the paint spouting orifice 7C, paint particles just sprayed out through the paint spouting orifice 7C stay approximately at the earth potential by contact with the fore end 42A of the grounding electrode 42. Being almost at the earth potential, the sprayed paint particles are less susceptible to the influences of dielectric polarization which occurs due to a voltage difference between the paint spouting orifice 7C and the external electrode 13, and readily undergo negative charging by the charging electrostatic field zone which is formed by the external electrode 13. As a result, even if the air nozzle 8 of insulating synthetic resin material holds negative charges on its surfaces, freshly sprayed paint particles are prevented from depositing on the air nozzle 8 to ensure higher finish quality of coated surfaces free of contamination by falling paint driblets as would result from paint deposition on the air nozzle 8.

Figure 4:
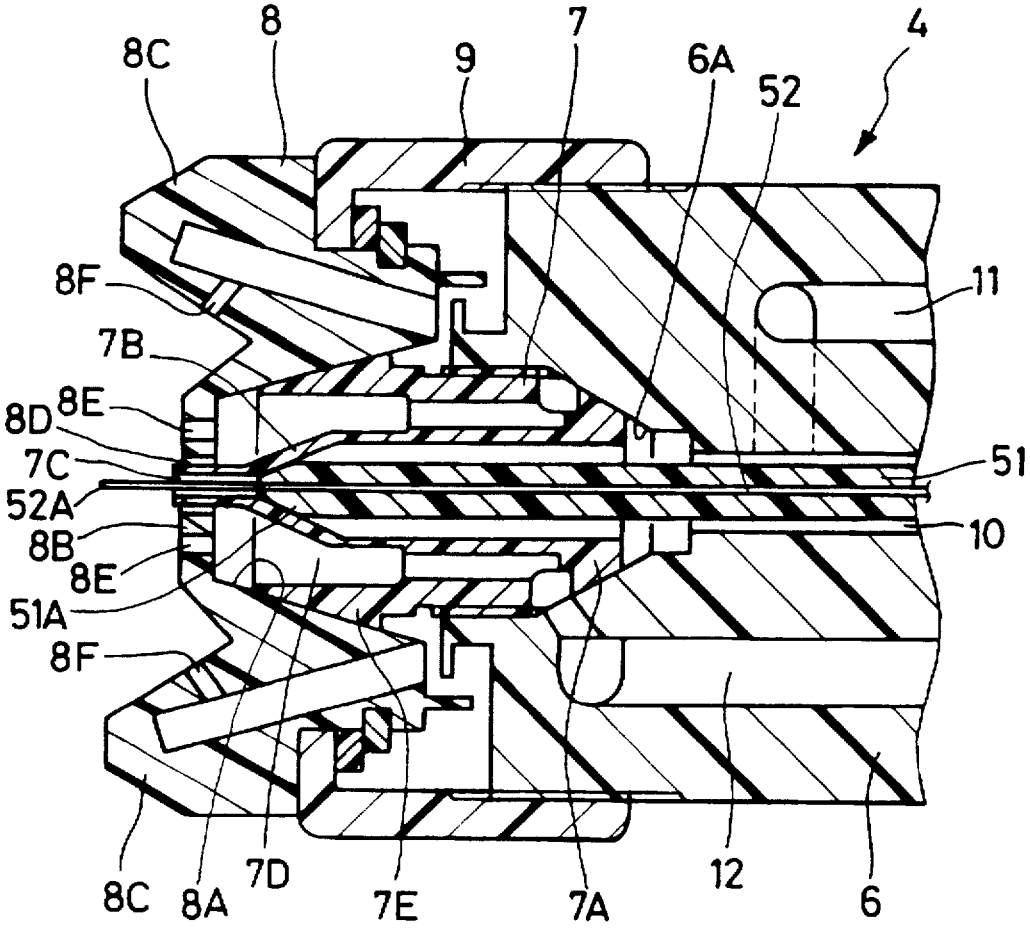
FIG. 4 is a view similar to FIG. 3 but showing a modification of the second embodiment.

Further, according to the invention, in place of the metallic needle valve body 41 of the paint valve 16 in the above-described second embodiment, there may be employed a needle valve body 51 of an insulating synthetic resin material as shown in FIG. 4, the needle valve body 51 similarly having its fore end portion 51A so shaped as to be seated and unseated on and off the valve seat portion 7B of the paint nozzle 7 and holding a grounding electrode 52 which is outwardly projected at its fore end 52A to produce the same effects as in the second embodiment. In the second embodiment, if desired, the grounding electrode 42 may be formed as an integral part of the needle valve body 41 of a conducting metallic material.

Figure 5:
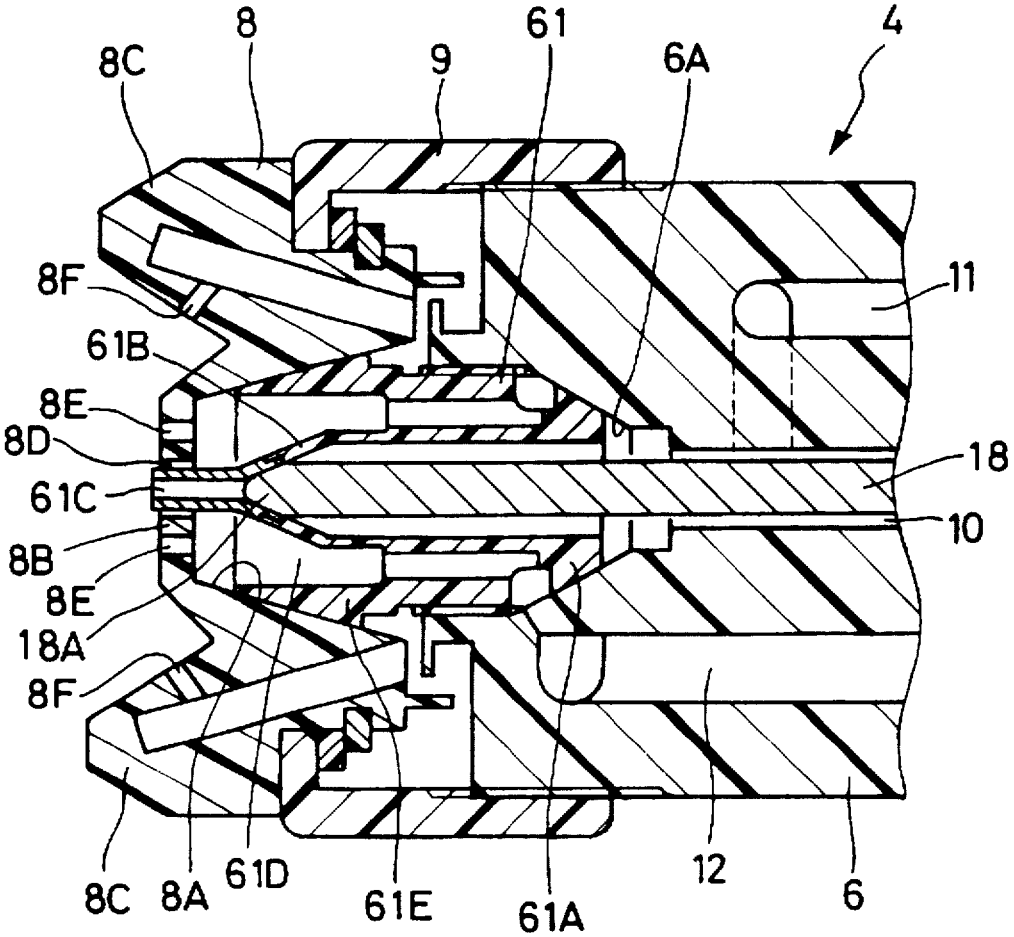
FIG. 5 is a fragmentary longitudinal section of a spray gun type electrostatic paint coating machine shown as a third embodiment of the invention.

Referring to FIG. 5, there is shown a third embodiment of the invention, which is characterized by a paint nozzle which is made of a combination of an insulating synthetic resin material and a conducting metallic material. In the following description of the third embodiment, those component parts which are common with the foregoing first embodiment are simply designated by common reference numerals or characters without repeating same explanations.

In FIG. 5, indicated at 61 is a paint nozzle which is employed in this embodiment, the paint nozzle 61 being constituted by a fitting portion 61A, a valve seat portion 61B and an atomizing air passage 61D, which are made of an insulating synthetic resin material as will be described later, and a paint spouting orifice 61C which is made of a conducting metallic material separately from other parts of the paint nozzle.

With regard to the shape, the paint nozzle 61 is internally formed with a paint passage in the same manner as the prior art paint nozzle 7, and constituted by a fitting portion 61A which is tapered off toward its rear end to fit tightly in the nozzle receptacle portion 6A on the spray gun body 6, a valve seat portion 61B for seating and unseating the needle valve body 18, a paint spouting orifice 61C of a conducting metallic material which is projected forward of the valve seat portion 61B to spray the paint when the needle valve body 18 is opened, an atomizing air passage 61D which is formed around the outer periphery of the valve seat portion 61B, and an annular projection 61E which is located around the outer periphery of the atomizing air passage 61D and projected forward in the form of an annular ring of a larger diameter on the front side and in abutting engagement against the recessed receptacle portion 8A of the air nozzle 8.

As described above, in this embodiment, the paint spouting orifice 61C alone is made of a conducting metallic material, and integrally joined with the remainder of the nozzle by resin molding, more specifically, integrally with the fitting portion 61A, valve seat portion 61B and annular projection 61E which are made of an insulating synthetic resin material.

In the case of the electrostatic paint coating machine of this embodiment employing the above-described arrangements, i.e., employing the paint nozzle 61 with the paint spouting orifice 61C of a conducting metallic material formed separately from the fitting portion 61A, valve seat portion 61B and annular projection 61E of an insulating material, the paint nozzle 61 is retained substantially at the earth potential at the paint spouting orifice 61C. Consequently, in the same manner as in the foregoing embodiments, paint particles still remain at the earth potential at the instant when they are sprayed out through the paint spouting orifice 61C, and therefore positively charged immediately in the charging electrostatic field zone which is formed by the external electrode 13, also making it possible to enhance the quality of coatings.

Figure 6:
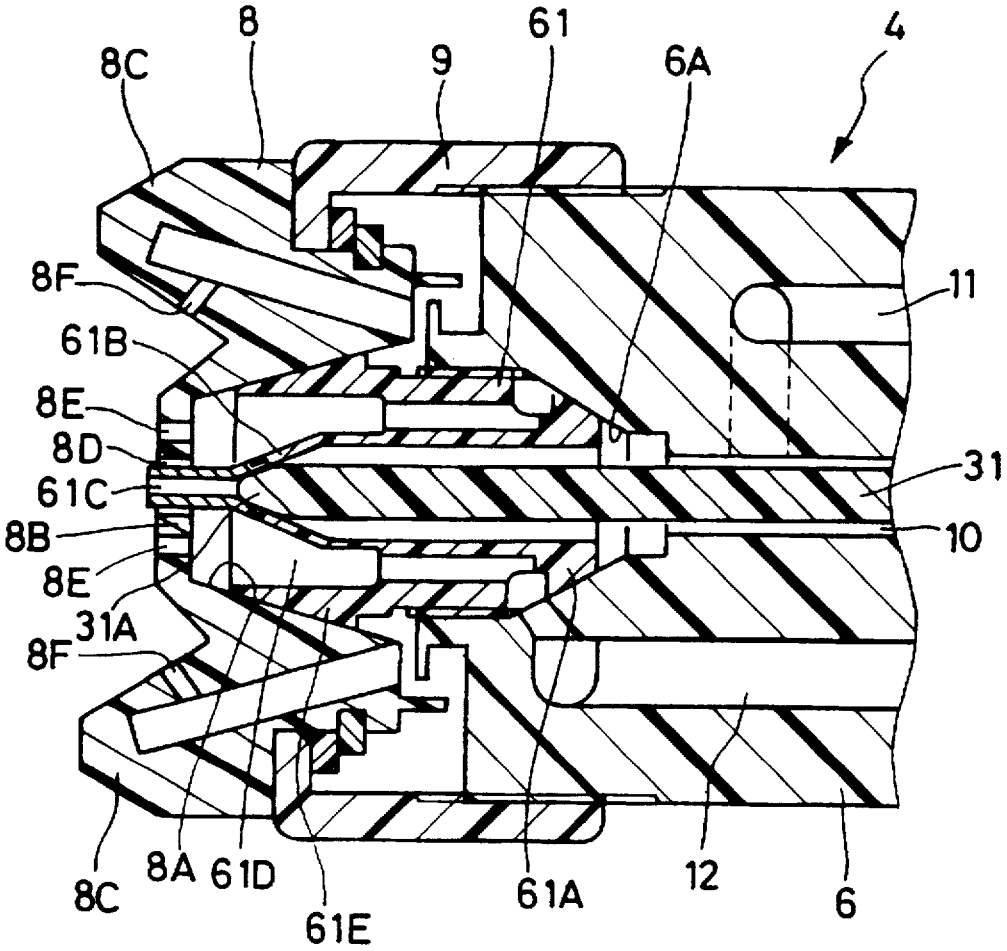
FIG. 6 is a view similar to FIG. 5 but showing a modification of the third embodiment.

Although the needle valve body 18 of the paint valve 16 in the above-described third embodiment is made of a metallic material as in the prior art coating machine, it may employ a needle valve body 31 of an insulating synthetic resin material as in the modification shown in FIG. 6. In this case, the paint spouting orifice 61C of the paint nozzle 61 can also function as a grounding electrode through a paint of low electrical resistance which flows through the paint supply passage 10, producing substantially the same effects as in the third embodiment.

Figure 7:
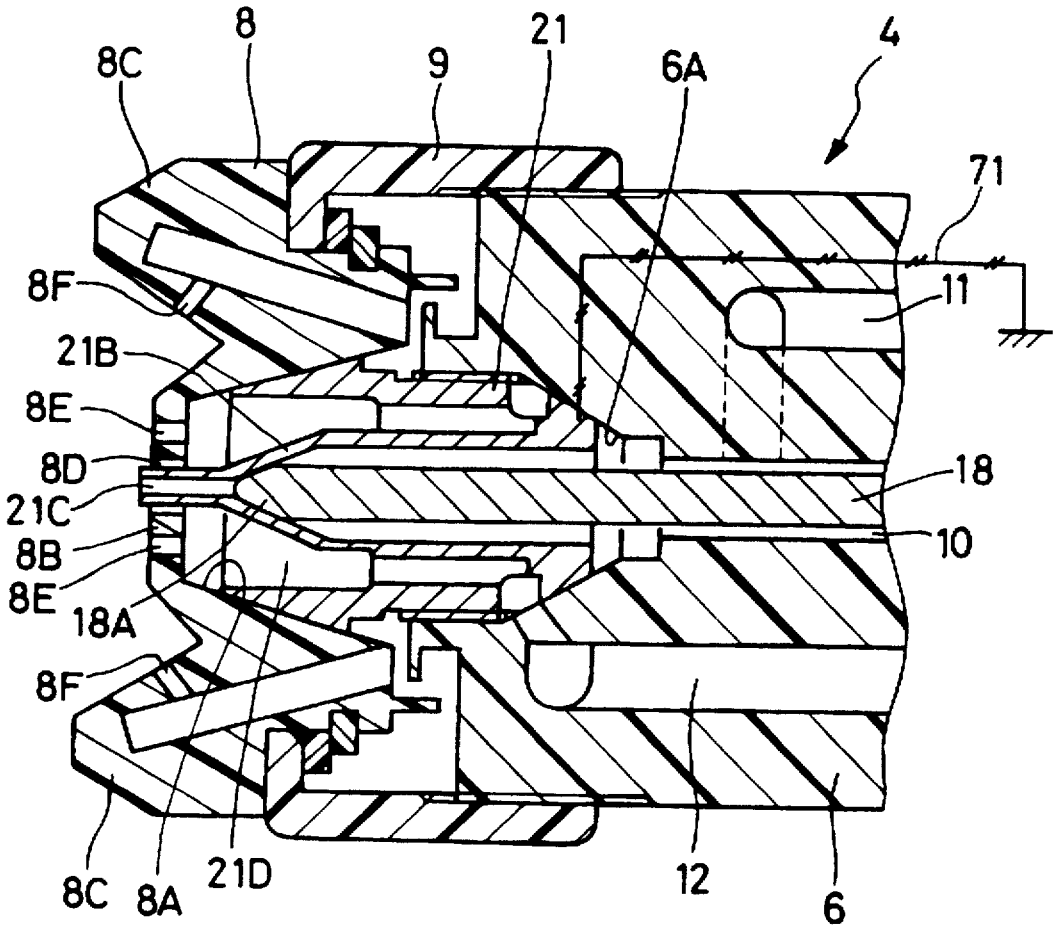
FIG. 7 is a fragmentary longitudinal section of a further modification employing a grounding wire.
Figure 8:
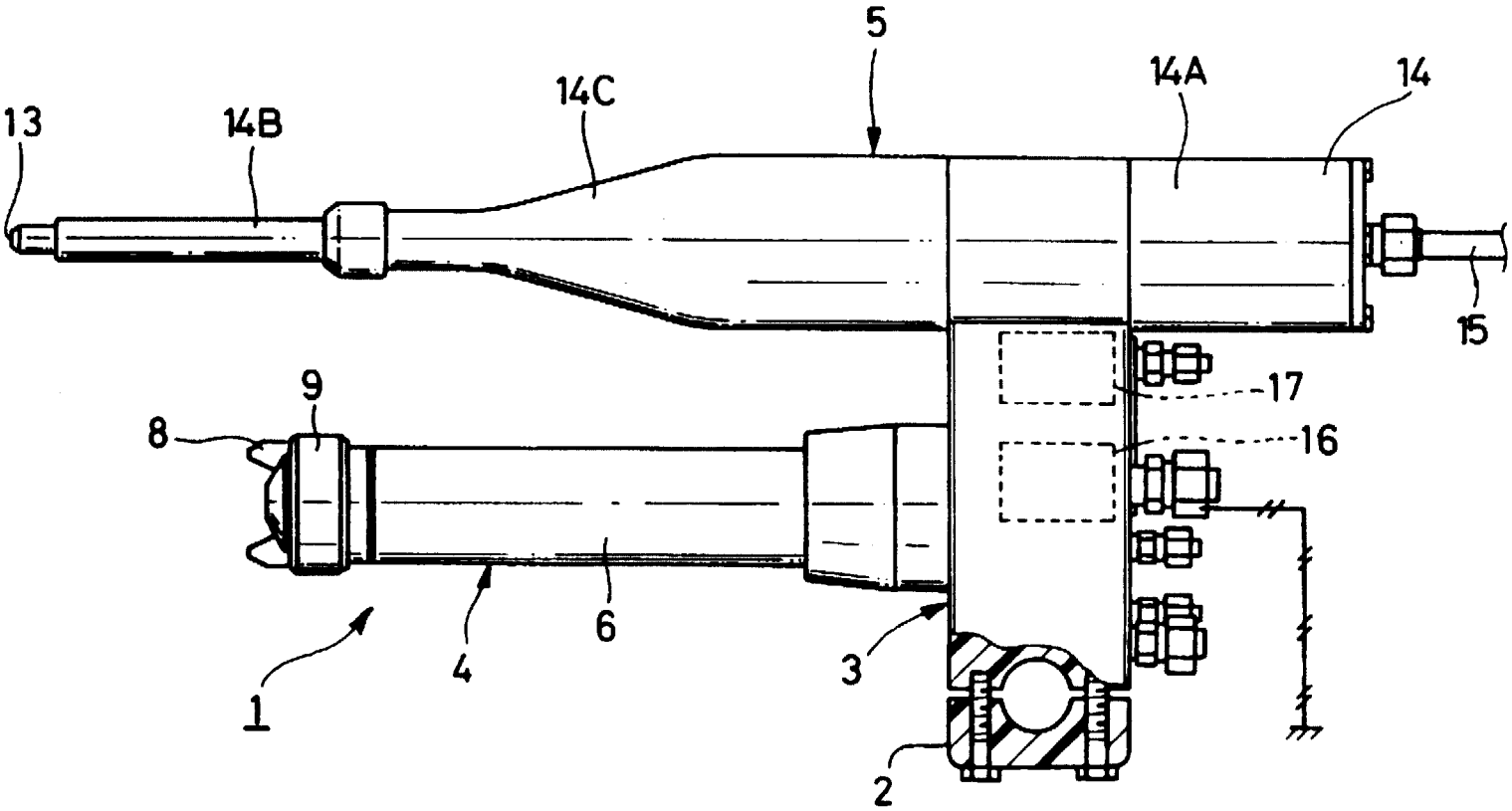
Fig. 8 PRIOR ART
FIG. 8 is a schematic side view of a prior art spray gun type paint coating machine.
Figure 9:
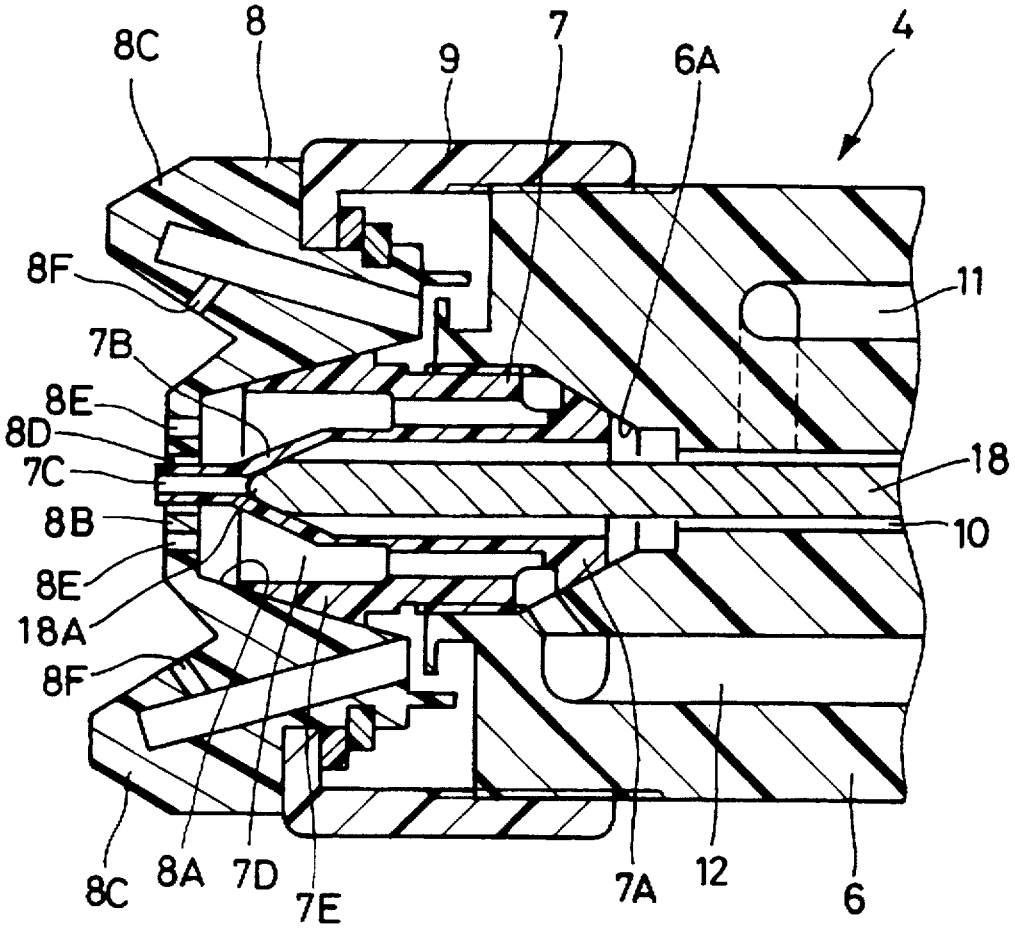
Fig. 9 PRIOR ART
FIG. 9 is a fragmentary longitudinal section of the prior art spray gun type electrostatic paint coating machine.

Further, the paint nozzle 21 is maintained at the earth potential by way of a paint of low resistance which flows through the paint supply passage 10. However, the present invention can be realized by other means, for example, by the use of a grounding wire 71 which is provided on the spray gun body 6 as shown in FIG. 7. Alternatively, a similar grounding wire may be provided on the spray gun body 6 if desired.

Furthermore, although the coating machine 4 in each of the foregoing embodiments employs an air atomization type spray gun, the present invention is similarly applicable to a spray gun of a hydraulically atomizing type using a lip-shaped nozzle tip for spouting out and atomizing a paint under high pressure.

INDUSTRIAL APPLICABILITY

As described in detail hereinbefore, the present invention employs a grounding electrode at or in the vicinity of a paint spouting orifice and in combination with a spray gun body and/or an air nozzle which are made of an insulating material, thereby making it possible to spray paint particles from the paint spouting orifice substantially at the earth potential and to let the sprayed paint particles be negatively charged quickly by the high negative voltage generated by the external electrode, substantially free of the influences of dielectric polarization which would otherwise take place due to a voltage difference between the paint spouting orifice and the external electrode. Consequently, it becomes possible to prevent contamination of the spray gun body and air nozzle of insulating material while improving the quality of coatings on articles.

In this case, by making the paint nozzle of a conducting material, the paint spouting orifice of the paint nozzle can be used as a grounding electrode which serves to hold the paint approximately at the earth potential at the instant when it is sprayed in the form of atomized particles. Accordingly, as soon as the paint is sprayed out, paint particles are negatively charged readily by the high negative voltage from the external electrode, allowing the operator to carry out a coating work without being troubled by contamination of the spray gun body or air nozzle.

Further, a grounding electrode may be provided on the needle valve body of the paint valve in such a way as to project on the front side through the paint spouting orifice of the paint nozzle, thereby holding paint particles approximately at the earth potential when they are sprayed forward from the paint spouting orifice and letting them undergo negative charging by the high negative voltage from the external electrode immediately as soon as they come out of the paint spouting orifice. As a consequence, the operator is similarly allowed to carry out a coating operation free of contamination of the spray gun body and air nozzle.

Furthermore, a grounding electrode may be provided at the paint spouting orifice of the paint nozzle by making the paint spouting orifice of a conducting material while making the remainder of the paint nozzle of an insulating material, thereby spraying paint particles almost at the earth potential and similarly letting them undergo negative charging by the high negative voltage from the external electrode immediately as soon as they come out of the paint nozzle.

On the other hand, in accordance with the present invention, the grounding electrode itself is maintained at the earth potential by way of a conducting water-base paint or a paint of low resistance which flows through the paint supply passage.

Moreover, according to the present invention, the grounding electrode can be maintained at the earth potential by way of a grounding wire which is provided additionally on the spray gun body.

We claim:

1. A spray gun type electrostatic paint coating machine comprising:

a spray gun body;

a paint nozzle located at the fore end of said spray gun body and having a paint spouting orifice to spray a paint toward an article to be coated;

a paint valve provided in said spray gun body and having a needle valve body to open and close said paint nozzle for opening and stopping supply of the paint to said paint nozzle through said paint supply passage; and an external electrode located in a position radially outward of said spray gun body, wherein said spray gun body is made of an electrically insulating material and said paint nozzle is made of a conductive material to function as an internal grounding electrode at or in the vicinity of said painting spouting orifice.

2. A spray gun type electrostatic paint coating machine as defined in claim 1, wherein said needle valve body is provided with a grounding electrode projected forward through said paint spouting orifice of the paint nozzle.

3. A spray gun type electrostatic paint coating machine as defined in claim 1, wherein said paint nozzle is made of a conducting material only at a fore paint spouting end portion, and the remainder of said nozzle is made of an electrically insulting material, serving as a grounding electrode at or in the vicinity of said paint spouting orifice.

4. A spray gun type electrostatic paint coating machine as defined in claim 1, wherein said grounding electrode is maintained at the earth potential by way of a conductive paint flowing through said paint supply passage.

5. A spray gun type electrostatic paint coating machine as defined in claim 1, wherein said grounding electrode is maintained at the earth potential by way of a grounding wire.

6. A spray gun type electrostatic paint coating machine as defined in claim 1, wherein said grounding electrode is maintained at the earth potential by way of a conductive paint flowing through said paint supply passage.

7. A spray gun type electrostatic paint coating machine as defined in claim 2, wherein said grounding electrode is maintained at the earth potential by way of a conductive paint flowing through said paint supply passage.

8. A spray gun type electrostatic paint coating machine as defined in claim 3, wherein said grounding electrode is maintained at the earth potential by way of a conductive paint flowing through said paint supply passage.

9. A spray gun type electrostatic paint coating machine as defined in claim 1, wherein said grounding electrode is maintained at the earth potential by way of a ground wire.

10. A spray gun type electrostatic paint coating machine as defined in claim 2, wherein said grounding electrode is maintained at the earth potential by way of a ground wire.

11. A spray gun type electrostatic paint coating machine as defined in claim 3, wherein said grounding electrode is maintained at the earth potential by way of a ground wire.

12. A spray gun type electrostatic paint coating machine comprising:

a spray gun body;

a paint nozzle located at the fore end of said spray gun body and having a paint spouting orifice to spray a paint toward an article to be coated;

an air nozzle mounted on said spray gun body in such a way as to cover the front side of said paint nozzle while exposing said paint spouting orifice to the outside;

a paint valve provided in said spray gun body and having a needle valve body to open and close said paint nozzle for opening and stopping supply of the paint to said paint nozzle through said paint supply passage; and an external electrode located in a position radially outward of said spray gun body, wherein said spray gun body and said air nozzle are made of an electrically insulating material and said paint nozzle is made of a conductive material to function as an internal grounding electrode at or in the vicinity of said painting spouting orifice.

13. A spray gun type electrostatic paint coating machine as defined in claim 12, wherein said needle valve body is provided with a grounding electrode projected forward through said paint spouting orifice of the paint nozzle.

14. A spray gun type electrostatic paint coating machine as defined in claim 11, wherein said paint nozzle is made of a conducting material only at a force paint spouting end portion, and the remainder of said nozzle is made of an electrically insulting material, serving as a grounding electrode at or in the vicinity of said paint spouting orifice.

15. A spray gun type electrostatic paint coating machine as defined in claim 11, wherein said grounding electrode is maintained at the earth potential by way of a conductive paint flowing through said paint supply passage.

16. A spray gun type electrostatic paint coating machine as defined in claim 12, wherein said grounding electrode is maintained at the earth potential by way of a ground wire.

* * * * *